US006736469B2

(12) United States Patent
Long

(10) Patent No.: US 6,736,469 B2
(45) Date of Patent: May 18, 2004

(54) COMPUTER DESK AND WORKSTATION

(76) Inventor: Kenneth W. Long, 2753 Rolling Hills Dr., Monroe, NC (US) 28110

( * ) Notice: Subject to any disclaimer, the term of this patent is extended or adjusted under 35 U.S.C. 154(b) by 0 days.

(21) Appl. No.: 10/042,379

(22) Filed: Jan. 11, 2002

(65) Prior Publication Data

US 2002/0100395 A1 Aug. 1, 2002

Related U.S. Application Data

(60) Provisional application No. 60/260,653, filed on Jan. 11, 2001.

(51) Int. Cl.[7] ..... A47B 81/00; A47B 37/00

(52) U.S. Cl. ..... 312/223.3; 108/50.01; 108/1

(58) Field of Search ..... 312/223.3, 194, 312/208.1, 196; 108/50.01, 144.11; 248/917

(56) References Cited

U.S. PATENT DOCUMENTS

| | | | | | |
|---|---|---|---|---|---|
| 1,163,868 | A | * | 12/1915 | Sherer et al. | 312/117 |
| D165,707 | S | | 1/1952 | Buehler | |
| 2,704,235 | A | * | 3/1955 | Bion | 108/6 |
| 2,931,685 | A | * | 4/1960 | Butler | 312/196 |
| D203,276 | S | | 12/1965 | Faux et al. | |
| 3,557,791 | A | * | 1/1971 | Duffy | 606/1 |
| 3,862,785 | A | * | 1/1975 | Scheerhorn et al. | 312/223.4 |
| 4,146,342 | A | | 3/1979 | Cederholm | |
| 4,428,631 | A | * | 1/1984 | Cope et al. | 312/223.3 |
| 4,640,199 | A | | 2/1987 | Zigman | |
| 4,789,048 | A | | 12/1988 | Cramer et al. | |
| 4,884,773 | A | | 12/1989 | Becker | |
| 5,044,284 | A | * | 9/1991 | Gross | 108/10 |
| D327,790 | S | | 7/1992 | Sharar | |
| 5,287,815 | A | * | 2/1994 | Gross | 108/50.14 |
| 5,357,873 | A | | 10/1994 | Hilton | |
| 5,419,525 | A | | 5/1995 | Hilton | |
| 5,461,974 | A | | 10/1995 | Reneau | |
| 5,522,323 | A | | 6/1996 | Richard | |
| 5,536,078 | A | | 7/1996 | Novikoff | |
| 5,655,823 | A | * | 8/1997 | Schairbaum | 312/194 |
| 5,704,299 | A | | 1/1998 | Corpuz, Jr. et al. | |
| 5,845,586 | A | | 12/1998 | Moore | |
| 5,857,415 | A | | 1/1999 | Richard | |
| 5,896,817 | A | | 4/1999 | Hancock | |
| 5,954,408 | A | * | 9/1999 | Bogucki | 312/223.3 |
| 5,957,059 | A | * | 9/1999 | Burhman | 108/13 |
| 5,967,631 | A | | 10/1999 | Ko | |
| 5,974,985 | A | | 11/1999 | Flototto et al. | |
| 5,980,004 | A | * | 11/1999 | Shoenfeld | 312/223.3 |
| 6,170,406 | B1 | * | 1/2001 | Klein et al. | 108/50.01 |

FOREIGN PATENT DOCUMENTS

| | | | | |
|---|---|---|---|---|
| DE | 4009536 A1 | * | 9/1991 | A47B/17/00 |
| GB | 2252241 A | * | 8/1992 | A47B/81/00 |

* cited by examiner

*Primary Examiner*—Lanna Mai
*Assistant Examiner*—John Fitzgerald
(74) *Attorney, Agent, or Firm*—Foley & Lardner

(57) ABSTRACT

Flat prefabricated panels are fastened together to form a desk/computer workstation having an adjustable monitor support and an adjustable keyboard support. A vertical member on the monitor support panel which adjusts the position of a monitor is selectively movable along a slot formed therein. A slidable panel on the rear of the desk is used to control the height of the rear edge of the monitor support panel while slidable members on the inboard surfaces of side panels of the desk proper are used to adjust the height of the forward end of the monitor support panel. A keyboard support is adjustably mounted on the side panels by way of two pairs of flat panels. In a second embodiment, a hutch or equipment support shelf is mounted on the monitor support panel. The angle of an equipment support shelf of the hutch with respect to the horizontal is adjustable.

14 Claims, 8 Drawing Sheets

COMPUTER DESK AND WORKSTATION

This application claims priority to Provisional Application No. 60/260,653 filed on Jan. 11, 2001 and entitled Computer Desk and Workstation. The disclosure of this provisional application is hereby incorporated by reference thereto.

BACKGROUND OF THE INVENTION

1. Field of the Invention

The present invention relates generally to a desk arrangement for a computer and more specifically to a computer desk and workstation that is so designed and arranged that it can be readily assembled from a plurality of essentially simple, flat, prefabricated panel components using common commercially available tools/fasteners.

2. Description of the Related Art

U.S. Pat. No. 5,522,323 issued on Jun. 4, 1996 in the name of Richard, discloses an ergonomic computer work station which features keyboard and monitor supports which are adjustable with respect to one another and to the desk proper. This arrangement while being relatively convenient tends to suffer from the drawback that it is overly complex requiring relatively expensive, heavy, mechanical connection/stand arrangements that allow the monitor stand and keyboard to be selectively adjusted to desired positions. It further tends to lack the elegant/aesthetic appearance preferred in higher end office/home furniture.

SUMMARY OF THE INVENTION

The embodiments of the computer desk and work station arrangement according to the present invention have been developed in order to reduce the complexity and weight of a unit which can be sold in a disassembled state and which can be readily assembled from prefabricated flat panels using only commonly available tool/parts/fasteners.

The desk according to the present invention is compact and includes, in accordance with a first embodiment, a basic structure which provides adjustable support for a computer monitor, a user interface (e.g. keyboard support), and a recessed area for the disposition of a personal computer or the like. In a second embodiment the desk includes an adjustable equipment shelf or hutch that can support the personal computer and computer accessories such as disk drives, printers, speakers, modems, and the like.

The computer monitor support is adjustable and can orient the computer monitor at a preferred viewing angle and height. The user interface support of the basic unit is also adjustable and can support a user interface, such as a keyboard and/or mouse, at a preferred angle and height to reduce stress on the hands and wrist of the user.

The panels from which the basic unit and equipment shelf are constructed can be made from wood, plastic, metals, alloys, fiberglass, and other conventional materials. Combination of these materials is of course possible.

More specifically, a first aspect of the present invention resides in a desk arrangement comprising: a first and second spaced panels; a monitor support panel having a forward end pivotally mounted between the first and second side panels so as to be pivotal about an axis proximate a forward edge of the monitor support panel; and a monitor positioning member mounted on said monitor support panel so as to extend essentially normally to an upper flat surface of the monitor support panel and to be selectively positionalble on the monitor support panel.

In the embodiments, a slot is formed in the monitor support panel and the monitor positioning member is slidably arranged therein and securable in a selected position.

The above arrangement further includes a flat keyboard support panel adjustably supported on the side panels so as to be adjustable in both height and angle with respect to the side panels. Further, a forward end of the monitor support panel is pivotally supported on upper ends of first and second support members that are slidably supported on inboard surfaces of the first and second side panels and that are adjustably positionable thereon by manually manipulable fastening members.

In addition, this arrangement further includes a so called intermediate panel which is fastened between the first and second side panels at a location between the monitor support panel and a base panel that is fastened between the first and second side panels proximate lower ends of the first and second side panels, the intermediate panel being formed with recesses through which the first and second support members extend. It further includes a height adjustment member or panel slidably amounted on a cross member which interconnects the first and second side panels, the height adjustment panel engaging/supporting a rear end portion of the monitor support panel and including a manually manipulatable fastening arrangement that allows the position of the height adjustment panel to be adjusted and selectively fixed with respect to the cross member whereby a height of a rear edge of the monitor support panel with respect to the first and second side members is adjustable.

The keyboard support panel is supported on the first and second side panels by a connection arrangement comprising: first and second keyboard height adjustment panels which are respectively connected through elongate height adjustment slots formed in the first and second keyboard height adjustment panels manually manipulable fastening members; and first and second angle adjustment panels which are rigidly connected to a lower surface of the keyboard support panel and which have arcuate slots formed therein, the first and second angle adjustment panels being pivotally supported on the first and second height adjustment panels and adjustable to and fixable at predetermined angles with respect to the first and second height adjustment panels.

A hutch can be fixed to the upper flat surface of the monitor support panel. This hutch includes third and fourth side panels which are respectively fixed to left and right sides of the monitor support panel; and an equipment support panel pivotally supported on the third and fourth side panels so as to be adjustable with respect to the angle of the monitor support panel. A plurality of legs can be optionally connected to a lower side of the above mentioned base panel.

A second aspect of the present invention resides in a desk arrangement comprising a plurality of prefabricated essentially flat panels adapted to be assembled using commercially available fasteners. In this arrangement the plurality of panels include: a monitor support panel which is adjustably supported on two vertical side panels so as to be adjustable in both height and angle; and a keyboard support panel which is adjustably supported on the two side panels.

A monitor positioning member which projects out of the above-mentioned monitor support panel and which is selectively securable in a selected position in an elongate slot formed in the monitor support panel.

In accordance with this aspect of the invention an equipment support shelf which is supported on the monitor support panel and which has an equipment support panel that is adjustable with respect to the monitor support panel, is also provided.

BRIEF DESCRIPTION OF THE DRAWINGS

The various features and advantages of the embodiments of the present invention will become more clearly appreciated as a detailed description of the preferred embodiments of the invention are given with reference to the appended drawings wherein.

DETAILED DESCRIPTION OF THE PREFERRED EMBODIMENTS

Figure 1:
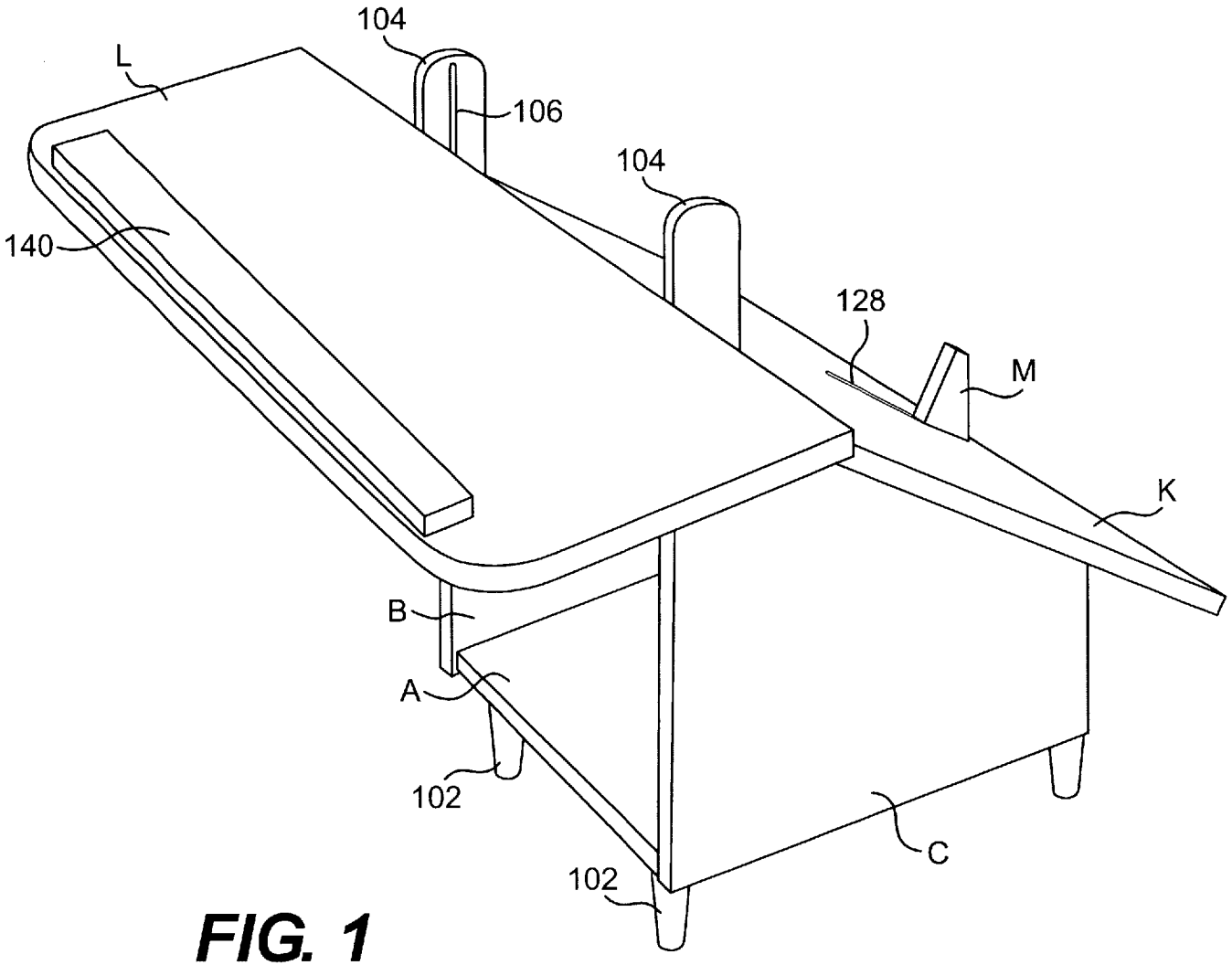
FIG. 1 is a perspective view of a first embodiment of the invention.
Figure 4:
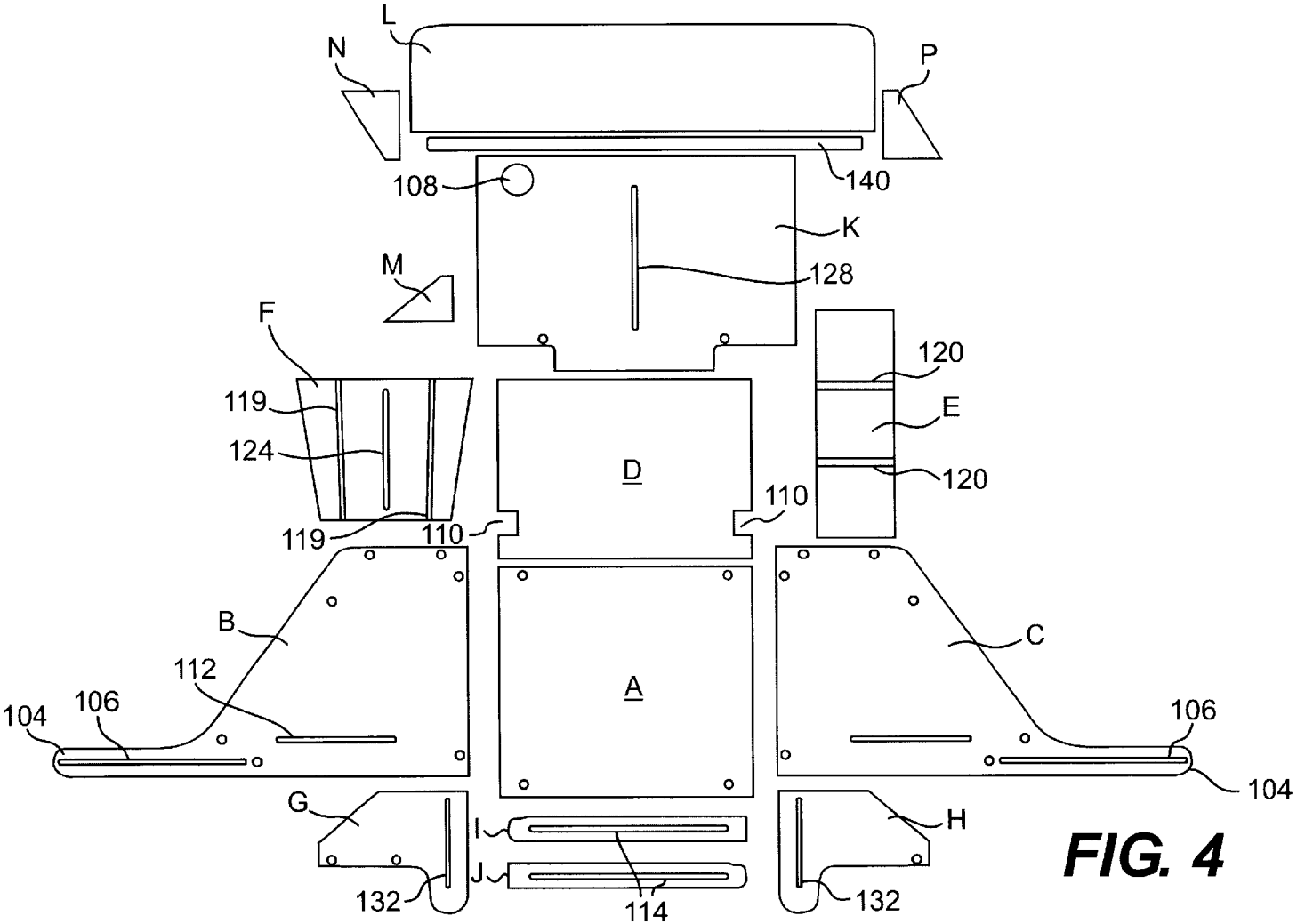
FIG. 4 is a plan view showing the parts which comprise the first embodiment laid out prior assembly.

FIG. 1 shows a first embodiment of the present invention. The prefabricated panels which are used in this embodiment are shown laid out in FIG. 4. These panels can be made of any suitable material such as wood, plastic, alloys, fiberglass, composites thereof, and are all essentially flat and therefore readily prefabricatable to provide the necessary openings, grooves and embedded members as will become clear as the disclosure proceeds.

In brief, the first embodiment consists of a basic desk arrangement that includes a base panel or member A which forms a lower member of desk proper and a pair of side panels B, C that are fastened to opposed side edges of the base member A. Legs 102 can be connected to the lower surface of the lower member A in the manner depicted in FIG. 1.

As will be noted, the side panels B, C include vertically extending arm extensions or arm portions 104 and are provided with a set of grooves 106 on their inboard surfaces. The purpose of these grooves 106 is to allow for the height of a keyboard tray or user interface support panel L to be adjusted. This feature will become more apparent hereinlater.

In this embodiment, the monitor support panel K is formed with a cable transfer opening 108. This opening is sized to receive a commercially available closure member for aesthetic purposes.

A panel D, which will be referred to as an "upper" panel is connected between the side panels at a predetermined height above the base panel A. This height is selected to enable the disposition of equipment such as the computer in the alcove-like space defined between panels A and D. This intermediate panel D is provided with slots or notches 110 on either side to allow for the height adjusting members I and J to extend therethrough and to be slidably movable along the inboard surfaces of the side panels B and C. As will be appreciated from FIG. 4, the side panels B, C are provided with a second set of guide grooves 112. Pins or the like guide members (not shown) which are provided on the height adjusting members I, J are adapted to slide in and be guided by these grooves 112.

In order to enable the height adjusting members I, J to be selectively locked in position, the members I, J are formed with elongate through slots 114 and position securing devices 116 which shall be referred to as "clamps". These clamps 116, in this arrangement, take the form of a threaded shaft which has a knob at one end. The knob is shaped to facilitate manual manipulation and the application of adequate amounts of torque. The threaded shaft is threadedly received in a threaded bore member (not shown) secured/embedded in each of the side panels at the indicated locations. A washer or washers can be disposed appropriately on the shaft to prevent damage to the surfaces which remain relatively stationary with respect to the shaft and knob. Simply tightening the clamps 116 down against the sides of the height adjustment members I, J, secures the height members I, J against relative movement with respect to the side panels B and C.

Figure 6:
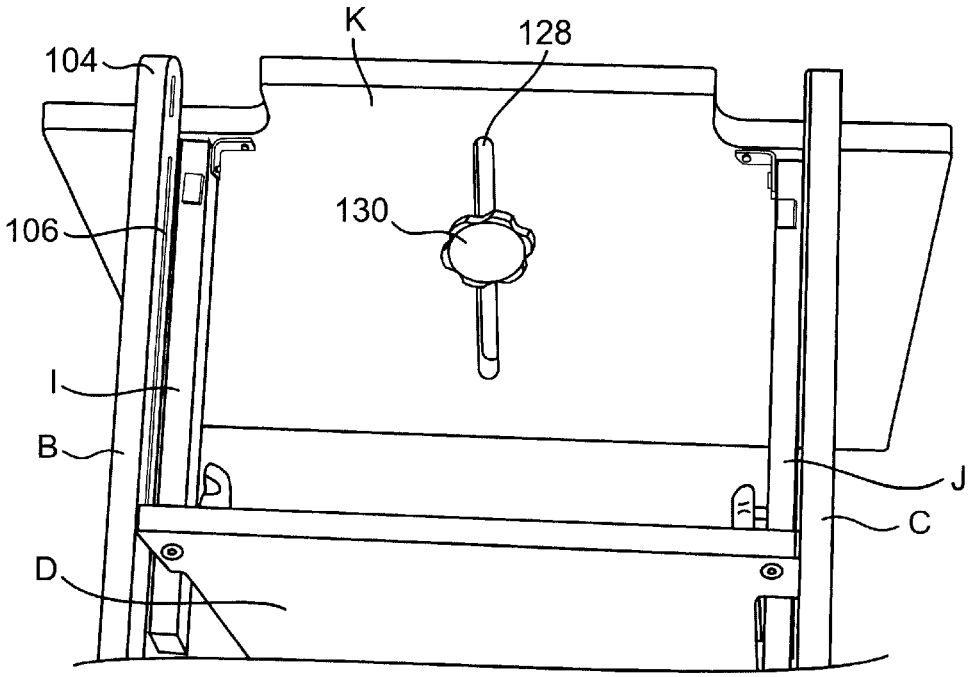
FIG. 6 is front view showing slidable members upon which the forward end of the monitor support panel are pivotally supported.
Figure 7:
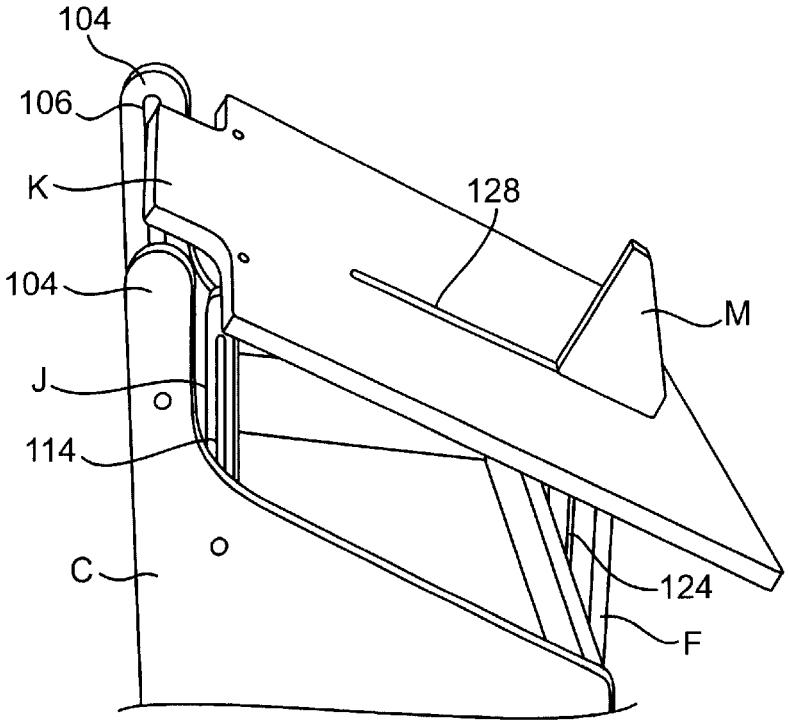
FIG. 7 is a view showing a vertically extending monitor position adjustment member provided on the monitor support panel.
Figure 8:
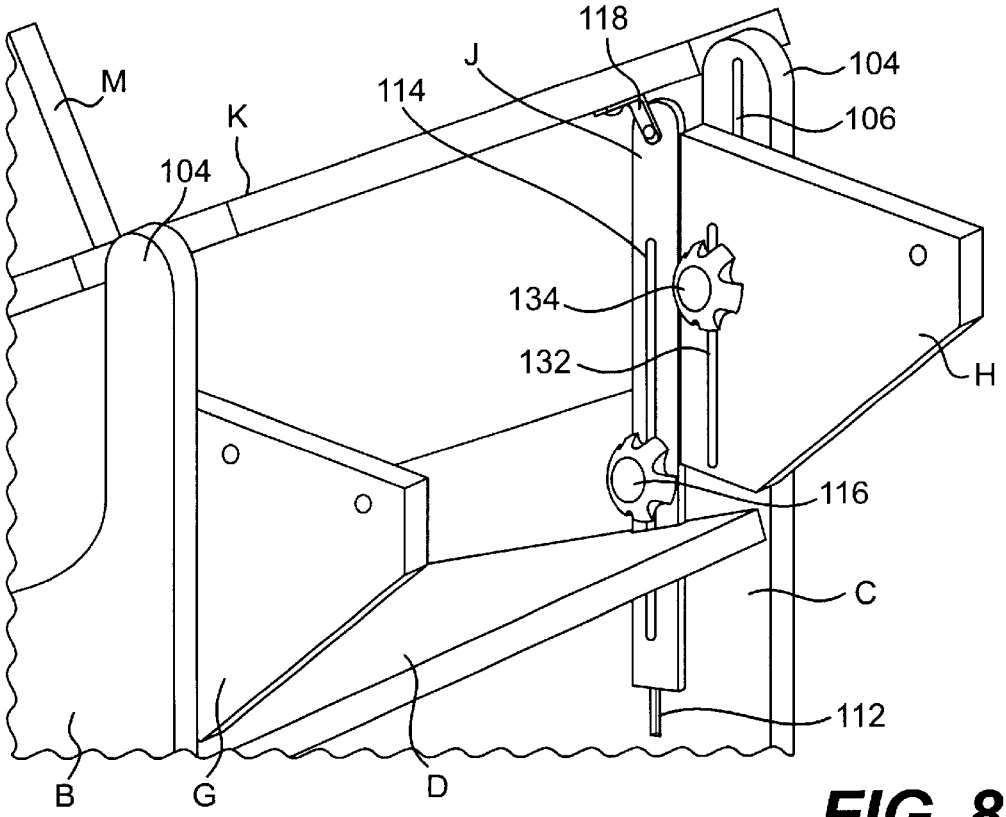
FIG. 8 is a perspective view showing vertically movable members associated with supporting a keyboard support member or panel.
Figure 9:
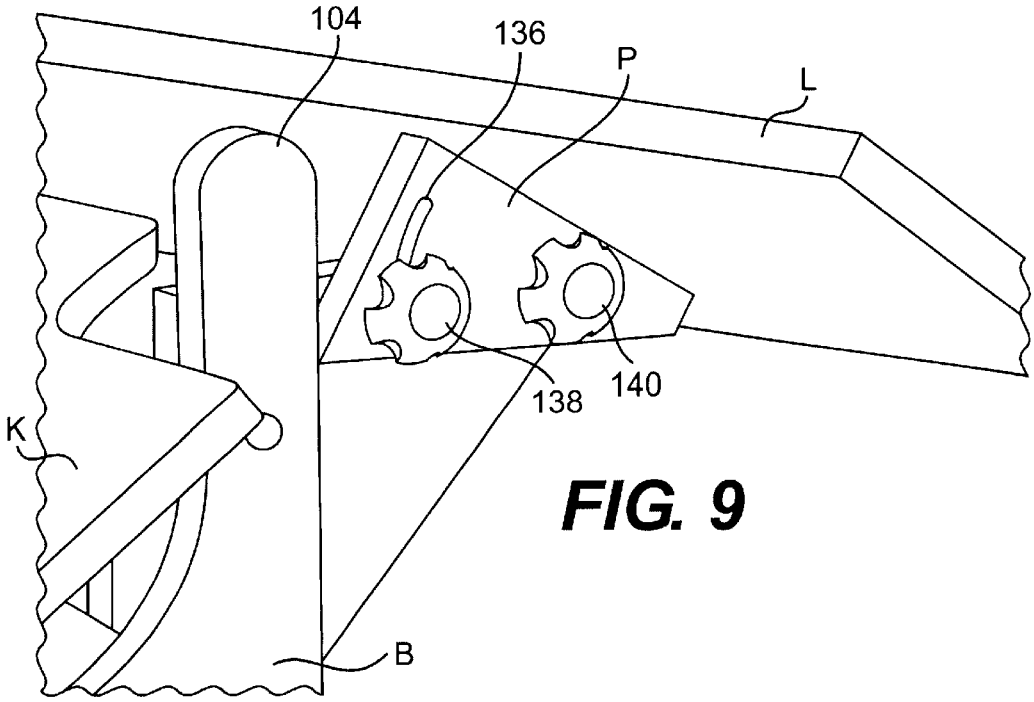
FIG. 9 is a perspective view showing the keyboard support member connected to the vertically movable members in a manner which allows for tiling of the same.

The upper ends of the height adjustment members I, J are provided with hinges 118 that are connected to the underside of a forward portion of the monitor support panel K in the manner illustrated in FIG. 6. This connection allows the height of the front of the monitor support panel K to be adjusted via releasing the clamps, adjusting the positions of the height adjustment members I and J, and re-tightening the clamps 116.

Figure 5:
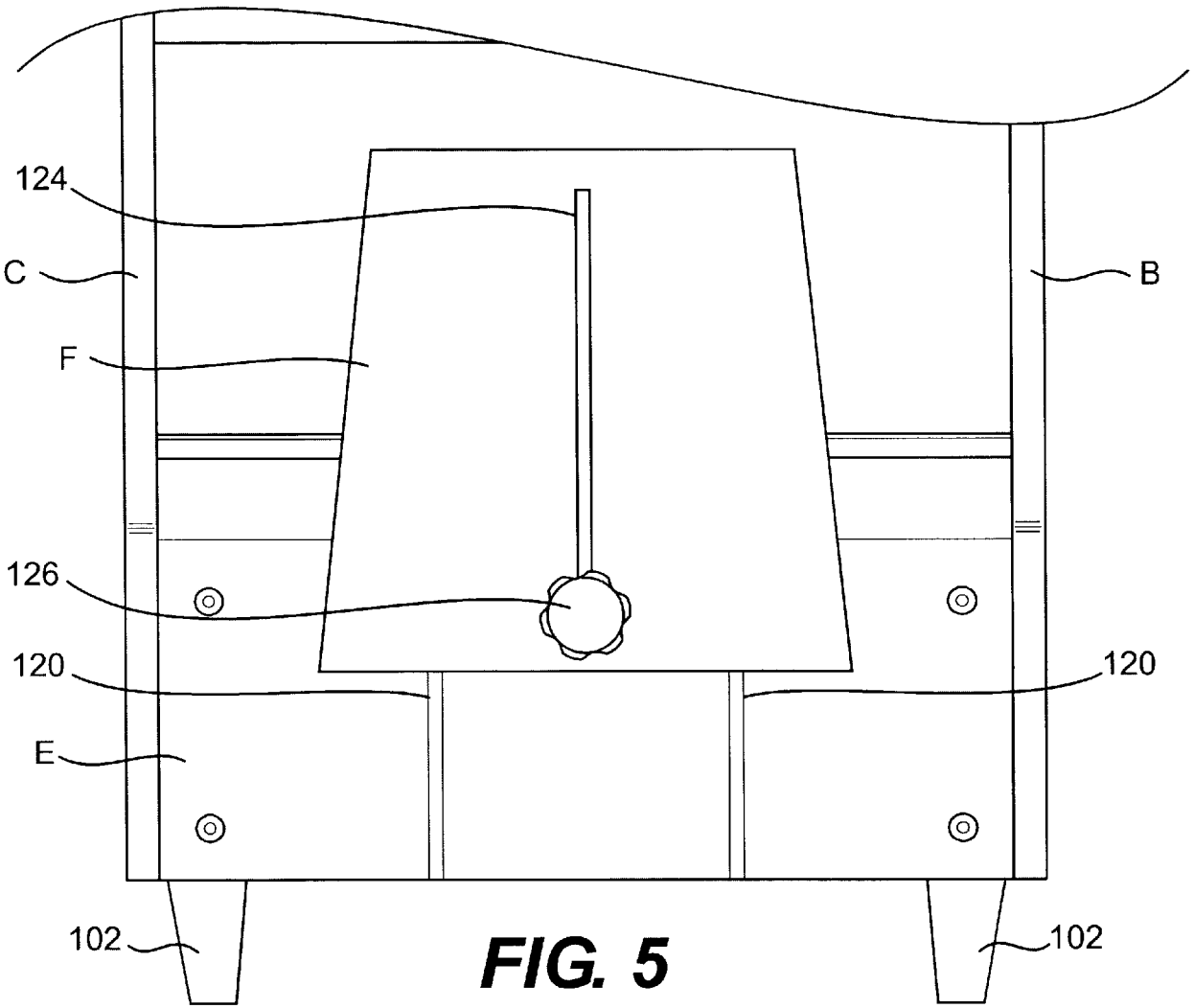
FIG. 5 is a rear view of a slidable panel used in connection with the positional adjustment of a rear end of a monitor support panel.

The height of the rear end of the monitor support panel K, on the other hand, is adjusted via a slidable height adjustment member F, which, as shown in FIG. 5, is mounted on a rear cross panel E that interconnects the lower rear edges of the side panels B, C. The height adjustment member F is provided on its inboard surface with a pair of spaced guide rails 119 or the like type of guide/slide elements/projections (not shown) which slide in grooves 120 formed in the external (outboard) surface of the cross panel E.

The height adjustment member F is also formed with a through slot 124, through which a clamp 126 that is received in a threaded bore member (not shown) embedded in the rear cross panel E, is disposed. This clamp 126 allows the height adjustment member F to be clamped in a selected position wherein it engages the underside surface of the monitor support panel K and supports it at a selected height. The combination of this rear height adjustment arrangement in combination with the two height adjustment members I, J located at the front, enables both the angle and height of the monitor support panel K to be adjusted over a wide range of values.

The monitor support panel K is provided with an elongate slot 128 via which a monitor positioning member M is adjustably mounted. A clamp 130 extends through the slot 128 from the underside of the monitor support panel K to engage in a threaded bore member (not shown) embedded in the lower edge of the monitor positioning member M. This clamp 130 allows the monitor positioning member M to be readily set in a position suitable for different sizes of CRT or LCD-type display units and/or allow for the distance (proximity of the screen) from the user's eyes to be selectively adjusted. The lower edge of the monitor positioning member M is provided with one or more guide pins (not shown) which slide in the elongate slot.

In this embodiment, the monitor positioning member M has an aesthetically pleasing shape which can be seen as resembling a shark fin. However, the shape and height of this monitor positioning member M is not limited to that illustrated and can have a simple elongate shaft-like configuration or the like, as desired/required.

The keyboard support panel L is supported on the vertically extending arms 104 by way of vertical displacement control members G and H which are each slotted (viz. provided with through slots 132) to permit the disposition of a clamp 134 therethrough and which have guide pins (not shown) that engage in the grooves 106 which are formed in the inboard surfaces of the arms 104. The clamps 132 associated with these vertical displacement control members G and H permit vertical positional adjustment within the limits of the slots 132 and the position of the threaded bore members which are embedded in the arms 104.

To permit tilting of the keyboard support panel L, connection members are fastened to the underside of the panel L and each provided with a through hole and an arcuate slot 136. Clamps 138, 140 are respectively disposed through each of the holes and the arcuate slots. Pivotal movement about the pair of clamps 140 that pass through the through holes is permitted while the selected angle can be set by tightening the clamps 138 which extend through the arcuate slots 136.

In the illustrated embodiment, a resilient wrist pad 140 is optionally bonded across the rear edge the keyboard support panel.

Figure 2:
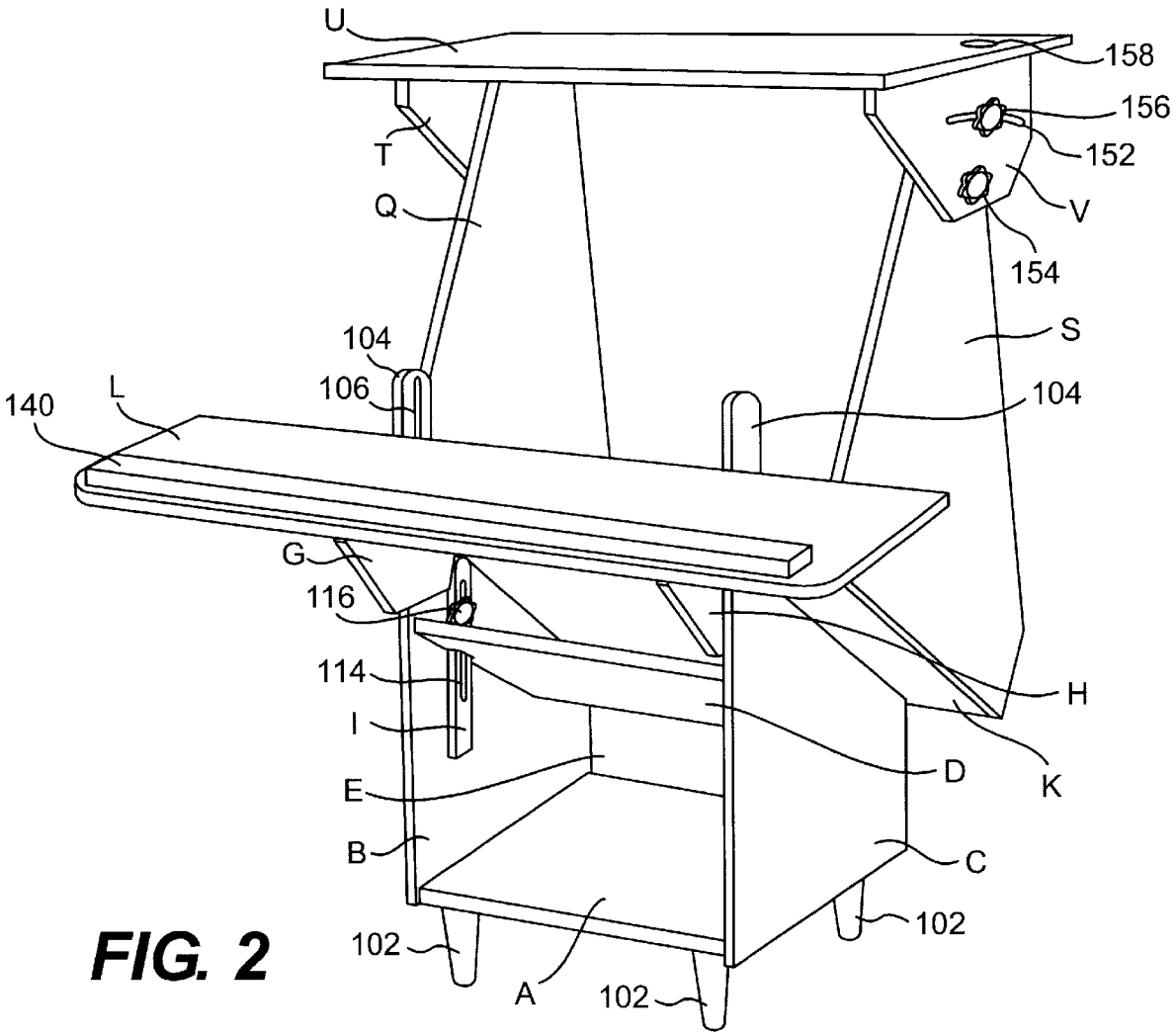
FIG. 2 is a perspective view of a second embodiment wherein a hutch or equipment shelf is added to the basic arrangement of the first embodiment.
Figure 3:
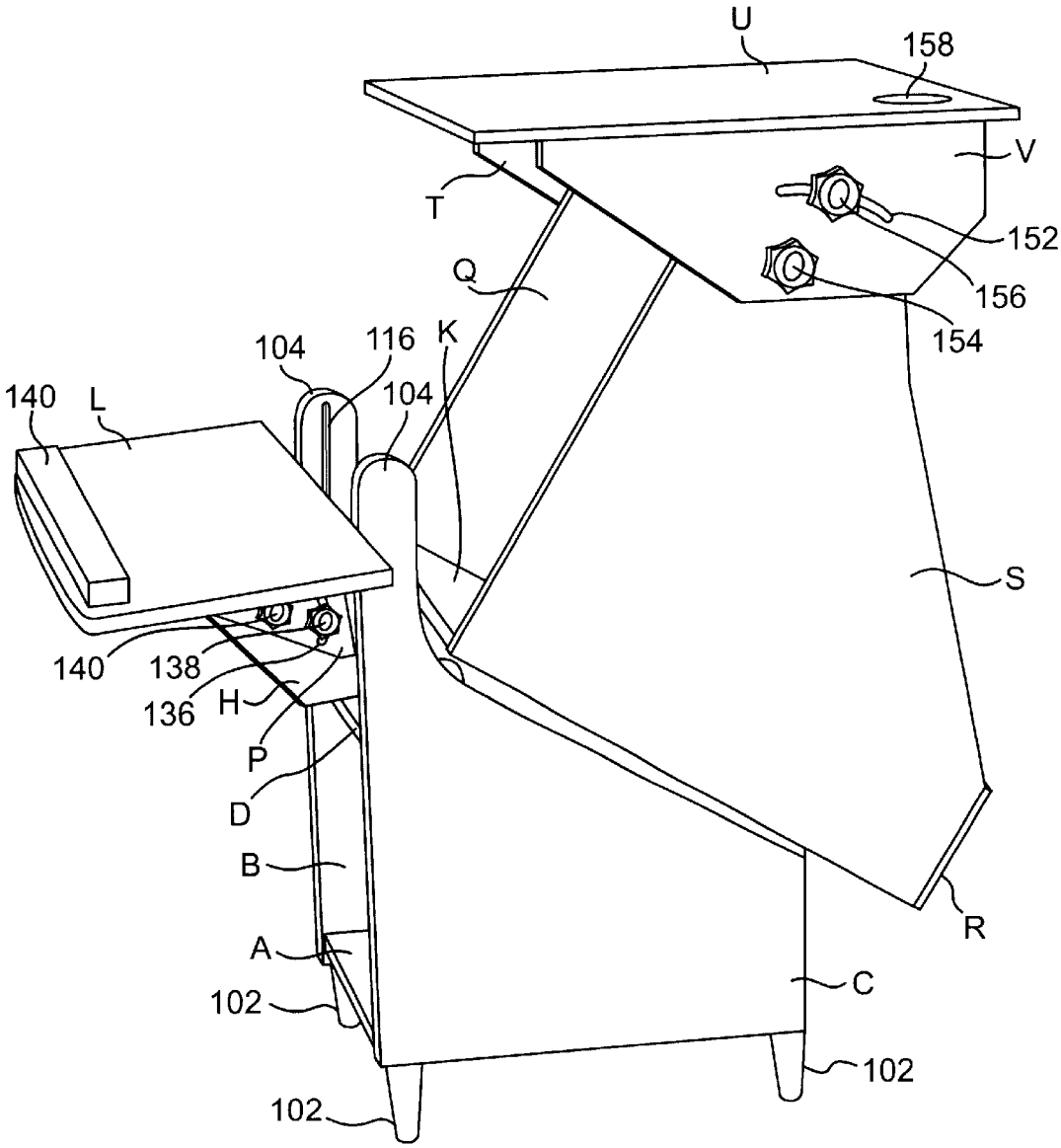
FIG. 3 is another perspective view of the second embodiment of the present invention.
Figure 10:
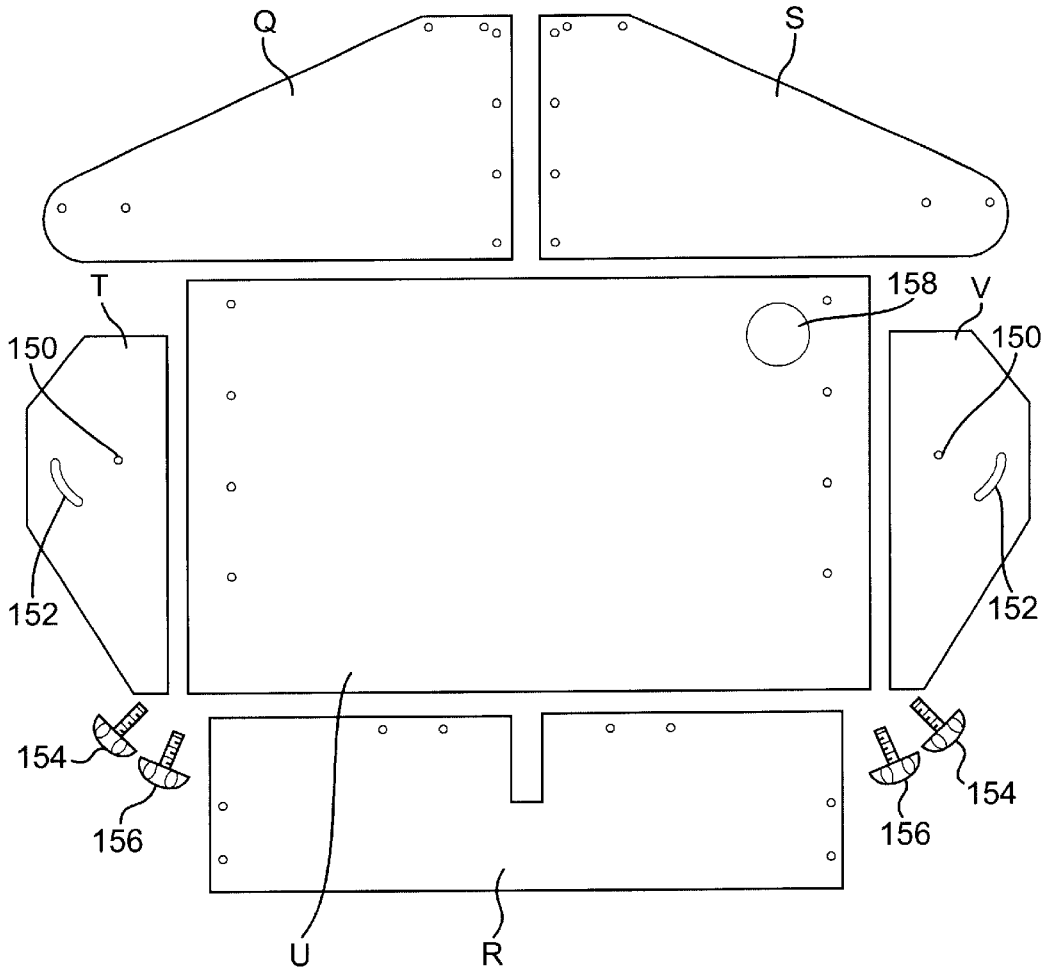
FIG. 10 is a plan view of panels which are assembled to form the hutch associated with the second embodiment of the invention.

The second embodiment will be now be discussed in connection with FIGS. 2, 3 and 10. This embodiment differs from the first in that a hutch or equipment support arrangement having a shelf is added to the basic arrangement of the first embodiment.

In this arrangement, the hutch sides Q and S are connected to the upper surface of the monitor support panel K. A cross panel R is connect to the rear edges of the hutch sides. Shelf support members V and T are secured to the lower surface of an equipment support panel or shelf U and are each provided with a through hole 150 and an arcuate through slot 152. Clamps 154, 156 are respectively disposed through each of the through holes 150 and arcuate slots 152. The unit comprised of the equipment support panel U and the shelf support members V and T, is pivotal about the shafts of the clamps 154 that pass through the through holes 150 while the clamps 156 which pass through the arcuate slots 152, enable the angle of the upper surface of the equipment support panel U to be adjusted with respect to the angular setting of the monitor support panel K and thus assume an essentially level condition wherein equipment/accessories such as a computer, printer, CD drives, speakers, modems and the like can be stably supported.

The equipment support panel U is formed with a cable transfer opening 158. This opening 158 can be fitted with a commercially available plastic closure member for aesthetic purposes.

In the disclosed embodiments, it is possible to prefabricate the panels to accept/contain and/or make use of fastening arrangements of the type disclosed in U.S. Pat. No. 4,146,342 issued on Mar. 27, 1979 in the name of Cederholm, and U.S. Pat. No. 5,536,078 issued on Jul. 16, 1996 in the name of Novikoff. The disclosure of these documents is hereby incorporated by reference thereto. The fasteners can be located, merely by way of example at the sites depicted by the small circles which appear along the edges of the various panels.

Optional reinforcement, such as L brackets and the like can be additionally included in the embodiments if additional rigidity is deemed necessary. The addition of further furniture features/elements to the sides of the basic unit such as document stands or like are, given the preceding disclosure, well within the purview of the person skilled in the art of office furniture or an art related thereto.

While the present invention has been described with reference to only a limited number of embodiments, it will be appreciated the various changes and modifications can be implemented without departing from the scope of the invention which is limited only by the appended claims.

What is claimed is:

1. A desk arrangement comprising;

spaced first and second vertical side panels:

a monitor support panel having an upper supporting surface and a forward end pivotally mounted between the first and second side panels so as to be pivotal about an axis proximate a forward edge of the monitor support panel: and a monitor positioning member mounted on said monitor support panel so as to project out of the upper flat surface of the monitor support panel and to be selectively positionable on said monitor support panel;

wherein said monitor support panel is formed with an elongate slot along which the monitor positioning member is slidable and wherein the monitor support member can be fixed in a selected position within the slot; and further comprising a keyboard support panel adjustably supported on the side panels so as to be adjustable in both height and angle with respect to the side panels; and wherein each of the side panels has a unitary vertically extending arm member, wherein each of the vertically extending arms is provided with a groove on its inboard surface, wherein the keyboard support panel is supported on the vertically extending arms by way of vertical displacement control members, wherein the vertical displacement control members are each slotted to permit disposition of a clamp therethrough, and wherein each of the vertical displacement control members have guide pins that slide in the grooves which are formed in the inboard surfaces of the arms.

2. A desk arrangement as set forth in claim 1, wherein the forward end of the monitor support panel is pivotally supported on upper ends of first and second support members that are slidably supported respectively on inboard surfaces of the first and second side panels and that are adjustable positionable thereon by manually manipulable fastening members.

3. A desk arrangement as set forth in claim 1, further comprising:

a height adjustment panel slidably mounted on a cross member which interconnects the first and second side panels, the height adjustment panel supporting a rear end portion of the monitor support panel and including a manually manipulatable fastening arrangement which allows the position of the height adjustment panel to be adjusted and selectively fixed with respect to the cross member whereby the height of the rear edge of the monitor support panel is adjustable.

4. A desk arrangement as set forth in claim 1, wherein the keyboard support panel is supported on the first and second side panels by a connection arrangement comprising:

first and second keyboard height adjustment panels which are respectively connected through elongate height adjustment slots formed in the first and second keyboard height adjustment panels and which are secured in selected positions by manually manipulable fastening members; and first and second angle adjustment panels which are rigidly connected to a lower surface of the keyboard support panel and which have arcuate slots formed therein, the first and second angle adjustment panels being pivotally supported on the first and second height adjustment panels and adjustable to and fixable at predetermined angles with respect to the first and second height adjustment panels.

5. A desk arrangement as set forth in claim 1, further comprising a hutch which is fixed to the upper surface of the monitor support panel, said hutch comprising:

third and fourth side panels which are fixed to the monitor support panel; and a shelf pivotally supported on the third and fourth side panels so as to be angularly adjustable with respect to the monitor support panel.

6. A desk arrangement as set forth in claim 1, wherein the monitor positioning member has a shark fin-shape.

7. A desk arrangement as set forth in claim 1, wherein the monitor positioning member has a trapezoidal shape.

8. A desk arrangement as set forth in claim 2, further comprising an intermediate panel which is fastened between the first and second side panels at a location below the monitor support panel, and a base panel which is fastened between the first and second side panels proximate lower ends of the first and second side panels, the intermediate panel being formed with recesses through which the first and second support members extend.

9. A desk arrangement as set forth in claim 2, further comprising a plurality of legs connected to an underside side of the base panel.

10. A desk arrangement as set forth in claim 3, wherein the height adjustment panel has a trapezoidal shape and has an elongate vertically extending slot formed therein, the elongate slot cooperating with a clamp which is received in a threaded bore member embedded in the cross member.

11. A desk arrangement comprising:

a plurality of prefabricated essentially flat panels adapted to be assembled using fasteners, said plurality of panels comprising:

a monitor support panel which is adjustably supported on two vertical side panels so as to be adjustable in both height and angle;

a keyboard support panel which is adjustably supported on the two side panels: and a monitor positioning member which projects upwardly from the monitor support panel and which is selectively securable in a selected position in an elongate slot formed in the monitor support panel; and wherein each of the vertical side panels has a unitary vertically extending arm member, wherein each of the vertically extending arms is provided with a groove on its inboard surface, wherein the keyboard support panel is supported on the vertically extending arms by way of vertical displacement control members, wherein the vertical displacement control members are each slotted to permit disposition of a clamp therethrough, and wherein each of the vertical displacement control members have guide pins that slide in the grooves which are formed in the inboard surfaces of the arms.

12. A desk arrangement as set forth in claim 11, wherein the monitor positioning member has a shark fin-shape.

13. A desk arrangement as set forth in claim 11, wherein the monitor positioning member has a trapezoidal shape.

14. A desk arrangement comprising:

a plurality of prefabricated essentially flat panels adapted to be assembled using fasteners, said plurality of panels comprising:

a tiltable monitor support panel which is adjustably supported on two vertical side panels so as to be adjustable in both height and angle;

a keyboard support panel which is adjustably supported on the two side panels;

a monitor positioning member which projects upwardly from the monitor support panel and which is selectively securable in a selected position in an elongate slot formed in the monitor support panel; and a hutch which is supported on an upper surface of the tiltable monitor support panel so as to be tiltable therewith, the hutch having a shelf that is angularly adjustable with respect to the monitor support panel.

* * * * *